US005259035A

United States Patent [19]

Peters et al.

[11] Patent Number: 5,259,035

[45] Date of Patent: Nov. 2, 1993

[54] AUTOMATIC MICROPHONE MIXER

[75] Inventors: Richard W. Peters, Algonquin; John G. Christopher, Berkeley, both of Ill.

[73] Assignee: Knowles Electronics, Inc., Itasca, Ill.

[21] Appl. No.: 739,486

[22] Filed: Aug. 2, 1991

[51] Int. Cl.[5] ..... H04R 27/00

[52] U.S. Cl. ..... 381/110; 381/92; 381/94; 379/202

[58] Field of Search ..... 381/92, 94, 110; 379/202, 203, 204, 205, 206

[56] References Cited

U.S. PATENT DOCUMENTS

| | | | |
|---|---|---|---|
| 3,437,758 | 4/1969 | Clement . | |
| 3,496,481 | 2/1970 | Torick et al. . | |
| 3,538,254 | 7/1970 | Ancha . | |
| 3,588,360 | 6/1971 | Knox . | |
| 3,730,995 | 5/1973 | Mathews . | |
| 3,755,625 | 8/1973 | Maston . | |
| 3,814,856 | 6/1974 | Dugan . | |
| 3,818,139 | 6/1974 | Snyder . | |
| 3,944,736 | 3/1976 | Shepard . | |
| 3,947,639 | 3/1976 | Nicholas et al. . | |
| 3,958,084 | 5/1976 | Nicholas . | |
| 3,992,584 | 11/1976 | Dugan . | |
| 4,090,032 | 5/1978 | Schrader . | |
| 4,149,032 | 4/1979 | Peters . | |
| 4,449,238 | 5/1984 | Lee et al. | 381/110 |

OTHER PUBLICATIONS

DE-4013 Voice-Matic Microphone Mixing System by Industrial Research Products, Inc.

1628A Automatic Microphone Mixer by Altec Sound Products.

Eleven-Day Sound System for 325,000 People Robert F. Ancha Sep. 1972.

"Invisible Sound Reinforcement With 350 Microphones" by Peter W. Tappan and Robert F. Ancha Oct. 1969.

Acoustical Treatment and Sound Reinforcing System for Washington State Legislature by Herbert T. Chaudiere Dec. 1970.

Audio Facilities for the Audio Engineering Society Conventions by Irving L. Joel, Keith A. Morris and Hugh N. Russell.

*Primary Examiner*—John K. Peng
*Assistant Examiner*—Edward Lefkowitz
*Attorney, Agent, or Firm*—Kinzer, Plyer, Dorn, McEachran & Jambor

[57] ABSTRACT

An automatic microphone mixer for a multi-microphone audio system in which each microphone audio channel is provided with a control channel including a comparator that compares the microphone output, as an A.C. signal, with a D.C. threshold signal, and that switches the microphone channel to "on" condition when the microphone signal exceeds the threshold; the threshold signal starts at a maximum level for a time T1 and then decreases as a function of time. A D.C. offset is added to the threshold signal in order to prevent low-level extraneous noise sources from activating a channel. All of the control channels are coupled to a threshold signal restoration circuit that drives the threshold signal back to its maximum level each time an audio channel is switched "on." An audio channel that has been switched "on" remains "on" for a time T2 substantially longer than the time T1. The number of channels currently in "on" condition is continuously monitored and the output gain is reduced whenever two or more channels are "on". The monitoring circuit is also connected to the control channels by a logic circuit and a selector switch. The logic circuit applies control signals to the control channels resulting in all channels either being "off" in the rest state, one channel being "on" in the rest state, or two channels being "on" in the rest state, depending on the setting of the selector switch.

11 Claims, 1 Drawing Sheet

VOLTAGE
TIME (Msec)
RECORDING OR BROADCAST
OUTPUT AMPLIFIER (ATTENUATOR)
REFERENCE VOLTAGE SUPPLY
SW1 - MODE SELECT
CHANNEL AMPLIFIER (ATTENUATOR)
SINGLE-SHOT MV
AUDIO SOURCE
FILTER
SINGLE SHOT MV

AUTOMATIC MICROPHONE MIXER

BACKGROUND OF THE INVENTION

This invention is an improvement on the audio mixer system of Peters U.S. Pat. No. 4,149,032, which discloses a priority mixer control for a multiple microphone audio system that can accomodate two, three or even more microphones "on" simultaneously without noticeable dropouts and with effective automatic control of the overall system gain to preclude excessive feedback.

Although the systems disclosed in the U.S. Pat. No. 4,149,032 are of great utility, they are subject to several shortcomings. First, when the system is in a rest state, i.e., when there are no active talkers, the microphone channels could randomly gate on and off due to background noise in the room. There is no provision to assure that all microphone channels are off when the system is at rest. Alternatively, there are some situations in which it may be desirable to maintain one or more microphone channels in an "on" state even when there are no active talkers. Again, the patent does not disclose a means to allow such a set-up.

This invention impacts primarily on the idle or resting state of the mixer; i.e., when there are no active talkers. The improvements seek to overcome the abovementioned shortcomings without compromising any of the unique features of the patent. The improvements provide for three different modes of operation in the rest state: first, a mode wherein all microphone channels are "off" in the rest state; second, a mode wherein just one microphone is "on" in the rest state; and third, a mode wherein just two microphones are "on" in the rest state. A mode select means is utilized to allow selection of one of the three modes.

With no active talkers (the system is in its rest state), the system microphones are subject only to background noise from sources such as air handling equipment, foot traffic, remote conversations, manufacturing noise and the like. Although such noise is normally low-level, random in time and space, and seldomly interferes with intelligibility, there are applications in which it is desirable to maintain all microphones in an "off" state when there are no active talkers. An example of such an application is a system in which the microphone channel status (on or off) is used as a source signal for controlling ancillary equipment such as television cameras or talker identification monitors. In such a system, momentary activation of a microphone channel, although perhaps audibly imperceptible, may lead to erroneous activation of the ancillary equipment.

There are other applications in which it may be desired or even necessary to keep one microphone channel "on" at all times. One such application is a radio or television broadcast, where the microphone mixer output is sent to remote listeners via a broadcast facility. During speaking pauses in such broadcasts, it is undesirable to have the microphone channels gate "on" and "off" due to ambient room noise, but it is also undesirable to have all channels "off", since remote listeners may depend on the microphones to transmit the room ambience. In such a situation, it is desirable to maintain one microphone channel "on" at all times in order to facilitate the transmission of the room ambience to the listening audience.

There are also applications in which it may be desireable to keep two microphone channels "on" at all times.

In one such application two channels may be active with music signals. When there are talkers speaking simultaneously on any two channels, naturally occuring pauses in speech allow the system to update the "on" status of each channel without noticeable channel drop-outs. Music, however, is a characteristically continuous signal, with no naturally occuring pauses to allow for updates. Any channel drop-outs which occur due to competition for system access are much more noticeable in music signals than in speech. Keeping two microphones "on" at all times eliminates the competition for system access and assures that the music signal will not be marred by channel drop-outs.

SUMMARY OF THE INVENTION

It is a principle object of the present invention, therefore, to provide a new and improved audio mixer system that includes a means to assure that all microphones except a selected number are effectively "off" in the rest state of the system, the selected number being zero, one or two.

A further object of the invention is to provide a new and improved audio mixer system that allows normal mixing operations of the "on" channels to take place regardless of the number of microphones "on" in the rest state.

Another object of the invention is to provide a new and improved audio mixer system that allows a threshold signal, which must be overcome in order to gain access to the system, to be set at a minimum level at all times in order to preclude actuation of one or more microphones from extraneous noise sources.

Accordingly, the invention relates to an audio mixer system of the kind comprising N audio sources, with $N>2$, each including a microphone and each developing an initial audio signal. The system has N audio channels, each connected to one audio source and each including a channel amplifier actuatable from a normal "off" condition to an "on" condition in response to a channel-on signal, and an output channel for additively combining the outputs of all the audio channels to develop a system output signal. A threshold signal generator means generates a D.C. threshold signal having an amplitude which decreases from a fixed maximum level as a function of time. There are N control channels, each including a comparator means for comparing the threshold signal with the initial audio signal from an associated audio channel and timing means for generating a channel-on signal whenever peak excursions for that initial audio signal exceed the threshold signal, the channel-on signal being applied to the channel amplifier in the associated audio channel. Threshold restoration means couple all of the control channels to the threshold signal generator and are provided for restoring the threshold signal each time a channel-on signal is initiated. Threshold maintenance means, connected to the threshold signal generator means, are provided for maintaining the threshold signal at a minimum given level at all times to preclude undesired actuation of one or more microphones from extraneous noise sources. Preferably, the mixer system includes a monitor circuit means, coupled to the audio channels, for generating a gain control signal whenever a plurality of audio channels are "on", and logic circuit means, connecting the monitor circuit means to the control channels, for maintaining a predetermined number of audio channels (zero, one, or two) in an "on" state at all times.

DESCRIPTION OF A PREFERRED EMBODIMENT

Figures 1, 2:
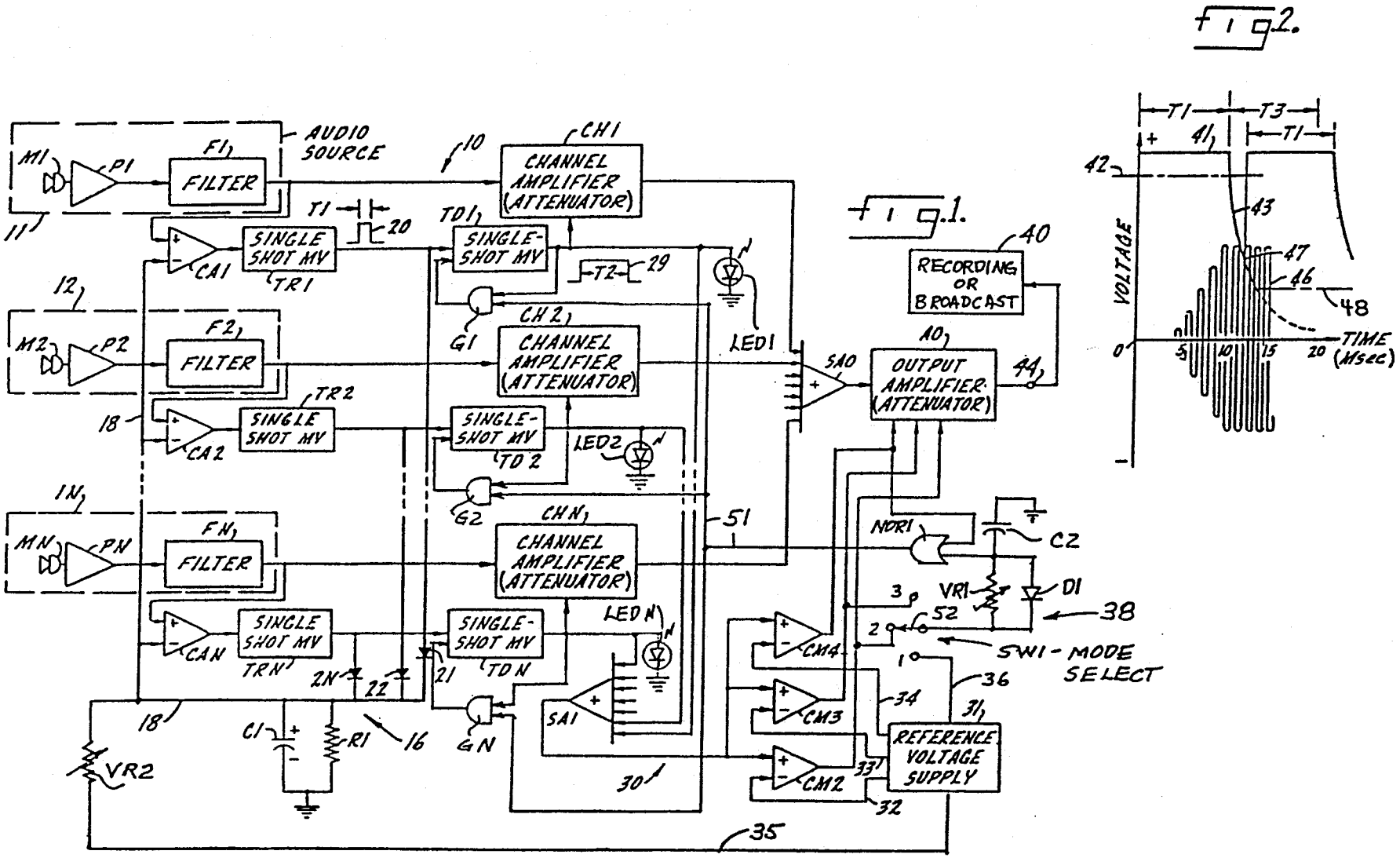
FIG. 1 is a block diagram of an audio mixer system, constructed in accordance with a preferred embodiment of the present invention.
FIG. 2 illustrates a representative waveform for a threshold signal employed in the audio mixer system of the invention.

FIG. 1 is a block diagram of an audio mixer system 10 which incorporates the priority mixer control disclosed in U.S. Pat. No. 4,149,032 along with improvements to the mixer according to the present invention; the priority mixer control of that patent is incorporated herein by reference. The operations of the system are fully disclosed in the earlier patent, but will be briefly reviewed in order to form a basis for the description of the improvements.

Audio system 10 of FIG. 1 includes a plurality of N individual audio sources (N>2). A first audio source 11 comprises a microphone M1 connected to a preamplifier P1 in turn connected to a speech filter F1. The other audio sources, such as sources 12 and 1N, include similar components.

Audio source 11 is connected to a first audio channel comprising a channel amplifier, the attenuator CH1. Amplifier CH1 is actuatable from a normal "off" condition to an "on" condition in response to an applied control signal. The outputs of audio sources 12 and 1N are similarly connected to channel amplifiers CH2 and CHN.

The audio system 10 of FIG. 1 further comprises an output channel including a mixer or summing amplifier SA0. The summing amplifier has a plurality of inputs, each connected to the output of one of the audio channels comprising amplifiers CH1, CH2 . . . CHN. Also included in the output channel is the output amplifier A0, to which the output of summing amplifier SA0 is connected. Amplifier A0 also receives gain control signals from a monitoring circuit 30, described more fully hereinafter. Monitoring circuit 30 sends gain control signals to amplifier A0 representative of the number of audio channels in an "on" state. Amplifier A0 is connected to an output terminal 44 which may be connected to additional amplifiers, speakers and other appropriate recording, broadcast, or sound reproducing devices generally indicated at 40.

Audio system 10, FIG. 1, also includes a threshold signal generator 16, which generates a D.C. threshold signal having an amplitude which decreases from a fixed maximum level as a predetermined function of time. This threshold signal is transmitted along a conductor 18 to one input of a channel comparator amplifier CA1. Comparator amplifier CA1 is the first component of the control channel associated with the audio channel for source 11. A second input to comparator CA1 is the initial audio signal developed by source 11. The output of comparator CA1 is connected to a first timing device comprising a single-shot trigger circuit TR1 which produces an output signal 20 of duration T1.

The control channel for the first audio source 11 also includes a second timing device comprising a one-shot trigger circuit TD1 having its input connected to the output of the first timing device TR1. The output 20 of trigger circuit TR1 is also connected to the threshold signal generator 16. Trigger circuit TD1 generates a channel "on" signal of duration T2, where T2 is much longer than T1, whenever the initial audio signal developed by source 11 exceeds the current threshold signal amplitude. Trigger circuit TD1 also receives as an input the output signal of AND gate G1 which is a part of a logic circuit means to be discussed more fully hereinafter. The output of TD1 is connected to channel amplifier CH1 and serves as a control signal to actuate CH1 between its normal "off" condition and its alternate "on" condition.

Each of the remaining audio channels in system 10 is also provided with an associated control channel similar in construction to the control channel just described for channel amplifier CH1. For example, channel amplifier CH2 has an associated control channel comprised of comparator CA2, a first trigger circuit TR2, and a second trigger circuit TD2. The control channel for channel amplifier CHN includes a comparator CAN and timing devices TRN and TDN.

System 10 also includes a monitoring means 30 for generating a series of gain control signals employed to control the operation of output amplifier A0. The first component of monitoring means 30 is a summing amplifier SA1. Amplifier SA1 has as its inputs the output signals produced by trigger circuits TD1, TD2, . . . TDN. Monitoring means 30 also comprises a reference voltage supply 31 having five outputs 32, 33, 34, 35, and 36. Outputs 35 and 36 of supply circuit 31 are associated with the improvements in audio system 10 afforded by the present invention, and will be discussed more fully hereinafter. The voltage on line 32 is of constant amplitude, slightly less than twice the amplitude of the output signals 29 from the channel-on trigger circuits TD1, TD2, . . . TDN. The output on line 33 is of constant amplitude slightly less than three times the channel-on signal 29 amplitude, and line 34 has a constant voltage of amplitude slightly less than four times the amplitude of channel-on signal 29.

In monitoring means 30 there are three comparator amplifiers CM2, CM3 and CM4. Comparator CM2 has as one input the output 32 of voltage supply 31 and as a second input the output of summing amplifier SA1. Comparator CM2 produces a gain control signal which is fed to output amplifier A0 whenever two audio channels are "on" (whenever the output of the summing amplifier SA1 exceeds the output 32 of voltage supply 31). Comparator amplifier CM3 has one input from amplifier SA1 and another input from reference output 33, and produces a gain control signal whenever three audio channels are "on". Comparator CM4 has inputs from amplifier SA1 and reference output 34, and generates a gain control signal whenever four or more audio channels are "on".

FIG. 2 illustrates a typical threshold signal generated by the threshold signal generator. It has a maximum threshold level 41 which is preferably somewhat higher than the maximum amplitude 42 for the initial audio signal developed by source 11. The signal decreases in amplitude as a predetermined function of time, as shown by curve 43. The threshold signal approaches zero in a time period T3 that is equal to or less than interval T1. Note, however, that the threshold maintenance means of the present invention, to be described hereinafter, causes the threshold signal to decrease in amplitude only to a predetermined minimum level 48, in order to prevent extraneous noise sources from activating a channel.

Audio source 11 produces an initial audio signal as generally indicated by signal 46 in FIG. 2. Comparator CA1 continuously compares this signal with the threshold signal 41, 43. At point 47, signal 46 exceeds the threshold signal. At this point comparator CA1 generates an output which actuates the first trigger circuit TR1, FIG. 1. TR1 produces an output 20 of duration T1 which in turn actuates the second trigger circuit TD1. TD1 produces an output 29 of duration T2 which is applied to the channel amplifier CH1 and actuates the amplifier from its normal "off" condition to its "on" condition, allowing microphone M1 access to the audio channel for a duration T2.

The trigger circuit TR1 in the control channel functions as a threshold restoration means for restoring the threshold signal from threshold signal generator 16 to its maximum level. The output signal 20 from trigger circuit TR1 is supplied through diode 21 to capacitor C1, charging the capacitor and restoring the threshold signal. Capacitor C1 stays charged to its maximum voltage for a time T1, represented in FIG. 2 by line 41, and then begins to discharge through resistor R1, as shown in FIG. 2 by curve 43. While capacitor C1 is charged to its maximum, all remaining microphones are denied access to an audio channel.

If a second person begins to speak at microphone M2, there is a high probability of the second microphone gaining access to an audio channel, due to the alternating current nature of the comparison carried out in comparator amplifiers CA1 and CA2, and illustrated in FIG. 2. Even if microphone M1 stays active, the signal from microphone M1 is negative fifty percent of the time, during which a signal from microphone M2 can go positive, exceeding curve 43 and actuating channel amplifier CH2. Furthernmore, any pauses in speech by the person using microphone M1 will give a person using microphone M2 an opportunity to gain access to the system. Thus, the fast update by virtue of the rapid ramp decay time and the random nature of speech combine to readily allow two talkers to share system 10 without noticeable chopping of sounds.

When two audio channels are "on", comparator CM2 produces a gain control output signal which is applied to amplifier A0 to reduce overall gain by 3 dB. When three audio channels are "on", comparator CM3 produces a gain control signal which reduces the gain of amplifier A0 by 6 dB. Finally, if four or more audio channels are "on", comparator CM4 sends a gain control signal to amplifier A0 resulting in a gain reduction of 9.2 dB.

That concludes the discussion of the operation of the old audio mixer of U.S. Pat. No. 4,149,032. It has been only a cursory discussion but, as mentioned earlier, that patent is incorporated herein by reference and further details of the operation of the overall system may be found there.

An examination of the new and improved audio mixer system of this invention begins with a logic circuit means that includes a series of AND gates G1, G2 . . . GN, one for each control channel of system 10. The output of each AND gate G1, G2 . . . GN is connected to a control input of an associated one of the trigger circuits TD1, TD2 . . . TDN. When the output of gate G1 is high, it forces the output of TD1 to remain high as long as the output of AND gate G1 remains high. AND gates G2 and GN operate in a similar fashion.

Gate G1 has as one input the output of trigger circuit TD1 and as another input the output of a NOR gate NOR1, via a conductor 51. Gates G2 and GN have respective inputs from TD2 and TDN, and share the common input from gate NOR1 afforded by conductor 51. The logic state of gate NOR1 is controlled by two inputs. The first input is the logic state of comparator CM4, which is high only when four or more microphones are activated and low at all other times. The second input to gate NOR1 is controlled through a slow rise/fast release delay circuit 38. The output of gate NOR1 is supplied as an input to AND gates G1 . . . GN via the bus 51.

The delay circuit 38 comprises a capacitor C2 connected from one input to gate NOR1 to ground, a diode D1 connected from the capacitor C2 to the movable contact 52 of a selector switch SW1, and a variable resistor VR1 connected in parallel with diode D1. Delay circuit 38 is driven by one of three sources selectable by the three-position mode select switch SW1. In the first position, with the movable contact 52 of the switch on its contact 1, the delay circuit is driven by output 36 of the reference voltage supply 31. The voltage on line 36 is equivalent to a logic high state. In the second position for switch SW1, with contact 52 on its fixed contact 2, the delay circuit 38 is driven by the logic state of the output of comparator CM2. Comparator CM2 has a logic low output whenever less than two microphones are activated and a logic high output whenever two or more microphones are activated. In the third position for switch SW1, the output of comparator CM3 drives delay circuit 38. Comparator CM3 has a logic low output whenever less than three microphones are activated and a logic high output whenever three or more microphones are activated.

Typically, delay circuit 38 is comprised of a capacitor C2 of 1.0 microfarads, a variable resistor VR1 adjustable from zero to 2.0 megohms, and a fast release diode D1 of the type IN4148. Capacitor C2 is connected to the input of NOR1 and is also returned to a plane of reference potential, shown in FIG. 1 as the system ground.

Light-emitting diodes LED1, LED2 and LEDN are connected respectively to the outputs of trigger circuits TD1, TD2 and TDN in order to provide an indication of whether a particular channel is in an "on" or an "off" state.

Output 35 of the reference voltage supply is connected via variable resistor VR2 to the threshold signal generator 16. Variable resistor VR2 supplies a D.C. offset voltage to the threshold signal generator 16, providing a threshold maintenance means for preventing extraneous noise sources from activating an audio channel.

Next, consider the operation of audio system 10 for each of the three positions of mode select switch SW1. In position 1, the logic high output 36 of reference voltage supply 31 is applied to the input of gate NOR1 via delay circuit 38. Gate NOR1 outputs a logic low along bus 51, regardless of the logic state of comparator CM4. Bus 51 supplies the logic low to the inputs of AND gates G1–GN; in turn, the output of each of gates G1–GN is a logic low, regardless of the output of trigger circuits TD1–TDN, which comprise the second inputs to AND gates G1–GN. Thus, the AND gates are disabled and audio system 10 operates as in U.S. Pat. No. 4,149,032 except for the DC offset signal applied to threshold signal generator 16.

In order for an audio signal generated by source 11 to activate an audio channel, the audio signal must overcome the DC offset voltage provided by variable resistor VR2 as well as the threshold signal generated by means 16. This prevents extraneous sources such as low level room noise from activating a channel. In effect, it insures that all microphones will be off in a rest state (when there are no active talkers). When a talker signal is generated by source 11, the DC offset and threshold signal will be overcome and the mixer will operate as described in U.S. Pat. No. 4,149,032. Variable resistor VR2 may be adjusted to vary the DC offset voltage.

Next, consider mode select switch SW1 set to position 2 with a single active talker at one of the microphones, specifically microphone M1. With only a single talker, comparators CM2 and CM4 both output a logic low signal, resulting in a logic high output from gate NOR1 on bus 51. This logic high is applied to AND gate G1. Since there is an active talker, the other input to gate G1, the output of trigger circuit TD1, is also a logic high. AND gate G1 accordingly outputs a logic high to the control input of trigger circuit TD1. Trigger TD1 will output an "on" signal for as long as AND gate G1 is in a logic high state. If the speaker at microphone M1 leaves or if the time interval T2 expires, gate G1 will continue to hold trigger TD1 in an "on" state.

If a talker begins speaking at microphone M2, audio amplifiers CH1 and CH2 will both be "on", and the output of comparator CM2 will become a logic high. After a brief time interval determined by components VR1 and C2 in delay circuit 38, typically 0.5 seconds, this high signal is applied to gate NOR1, causing the output on bus 51 to become logic low. This is applied to AND gate G1, causing its output also to go logic low, and releasing its hold on trigger circuit TD1. If the talker at microphone M1 has become inactive, amplifier CH1 will be turned off after time interval T2. When this occurs, the output of comparator CM2 returns to a logic low, which via delay circuit 38 causes gate NOR1 to go logic high, enabling AND gate G2 to hold trigger circuit TD2 in an "on" state. Thus, with mode select switch SW1 in position 2, the last microphone that has had an active talker is held "on", even after talk has stopped.

Delay circuit 38 acts to prevent transient noises of duration less than the time constant of the circuit from causing a transfer of the hold condition. The rapid decay via diode D1 insures that the hold condition will be transferred to the new active channel before the time interval T2 elapses.

Finally, consider mode select switch SW1 set to position 3. If there are two speakers, as at microphones M1 and M2, the output of comparator CM3 will be logic low, causing the output of gate NOR1 to be a logic high, and in turn causing AND gates G1 and G2 to output logic highs and hold each of the trigger circuits TD1 and TD2 in the "on" state. If a third speaker becomes active, as at microphone MN, comparator CM3 outputs a logic high, causing gate NOR 1 and gates G1 and G2 each to output a logic low, and releasing the hold of gates G1 and G2 on trigger circuits TD1 and TD2. When one of the three active microphones becomes inactive, comparator CM3 goes low again, and the two remaining active audio channels are held "on" by their respective AND gates, which now output a logic high. Thus, mode select switch SW1 set to position 3 results in the last two active microphones being held in an "on" state, even after the talk or other source signal has ended.

NOR gate NOR1 receives, in addition to its input from the mode selector switch SW1 via delay circuit 38, an input from comparator CM4. Regardless of the setting of switch SW1, if four or more microphones become active (e.g. loud applause), the output of CM4 will become a logic high causing NOR1 to go logic low and disabling the hold status for all audio channels. All hold operations will be disabled until the output of comparator CM4 goes low again (applause stops).

We claim:

1. An audio mixer system comprising:

N audio sources, each including a microphone and each developing an initial audio signal, with $N>2$;

N audio channels, each connected to one audio source and each including a channel amplifier actuatable from a minimum gain "off" condition to a maximum gain "on" condition in response to a channel-on signal;

an output channel for additively combining the outputs of all the audio channels to develop a system output signal;

threshold signal generator means for generating a D.C. threshold signal having an amplitude which decreases from a fixed maximum level as a function of time;

N control channels, each including comparator means for comparing the threshold signal with the initial audio signal from an associated audio channel and timing means for generating a channel-on signal whenever peak excursions for that initial audio signal exceed the threshold signal, the channel-on signal being applied to the channel amplifier in the associated audio channel;

threshold restoration circuit means, coupling all of the control channels to the threshold signal generator, for restoring the threshold signal each time a channel-on signal is initiated;

threshold maintenance means, connected to the threshold signal restoration circuit means, for maintaining the threshold signal at a given level at all times to preclude undesired actuation of one or more microphones from extraneous noise sources;

monitor circuit means, coupled to the audio channels, for generating a gain control signal whenever a plurality of audio channels are "on"; and logic circuit means, connecting the monitor circuit means to the control channels, and responsive to the monitor circuit means, for maintaining a predetermined number of audio channels in an "on" state at all times.

2. An audio mixer system according to claim 1 in which the threshold maintenance means is comprised of a variable resistor which supplies a DC offset voltage to the threshold restoration circuit means, the source voltage of the variable resistor being derived from a reference voltage supply.

3. An audio mixer system according to claim 1 and further comprising:

a reference voltage supply for generating a reference gain signal; and logic circuit means, connecting the reference gain signal to the control channels, for maintaining all audio channels in an "off" state when there are no active audio sources.

4. An audio mixer system according to claim 1 in which:

the monitor circuit means generates a gain control signal whenever at least two audio channels are "on"; and the logic circuit means maintains one audio channel "on" at all times, that one audio channel being the last audio channel receiving a channel-on signal from its associated control channel.

5. An audio mixer system according to claim 1 in which:

the monitor circuit means generates a gain control signal whenever at least three audio channels are "on"; and the logic circuit means maintains two audio channels "on" at all times, those two audio channels being the last two audio channels receiving channel-on signals from their respective associated control channels.

6. An audio mixer system according to claim 1 and further comprising:

a reference voltage source, for generating a reference gain control signal;

monitoring circuit means, coupled to the audio channels, for generating first and second gain control signals respectively indicative of two and three audio channels being "on";

selector means, for selecting one of the gain control signals as an active logic gain control signal; and logic circuit means, connecting the selector means to the control channels, for maintaining:

all audio channels "off" when there are no active talkers whenever the selector means is set for the reference gain control signal;

one audio channel "on" at all times whenever the selector means is set for the first gain control signal; and two audio channels "on" at all times whenever the selector means is set for the second gain control signal.

7. An audio mixer system according to claim 6 in which:

the monitoring circuit means generates a third gain control signal representative of at least four audio channels being "on"; and the logic circuit means connects the third gain control signal to the control channels, for disabling the means for maintaining audio channels "on" in the event that four or more microphones are simultaneously activated.

8. An audio mixer system according to claim 6 and further including a delay circuit means, interposed between the selector means and the logic means, for preventing transient noises from causing an audio channel to be set in an "on" state;

9. An audio mixer system according to claim 8 in which the delay circuit means has a time constant of approximately 0.5 seconds and is comprised of a capacitor, a variable resistor connected in series with the capacitor, and a fast release diode connected in parallel with the variable resistor.

10. An audio mixer system according to claim 6 in which the logic circuit means is comprised of a plurality of AND gates, with the output of each AND gate coupled to an associated audio control channel and with one input being the output of the associated control channel and the other input being driven by the output of a two-input NOR gate, such NOR gate having as one input a gain control signal, generated by the monitoring circuit means, which is representative of at least four audio channels being "on", and as its other input a gain control signal determined by the setting of the selector means.

11. An audio mixer system according to claim 1 and further including a plurality of light-emitting diodes, each coupled to the output of an associated audio control channel, for providing an indication of whether the associated channel is in an "on" or an "off" state.

* * * * *